US005906722A

United States Patent [19]

Foller et al.

[11] Patent Number: 5,906,722

[45] Date of Patent: May 25, 1999

[54] METHOD OF CONVERTING AMINE HYDROHALIDE INTO FREE AMINE

[75] Inventors: Peter C. Foller, Murrysville; David G. Roberts, Gibsonia; Robert H. Tang, Murrysville, all of Pa.

[73] Assignee: PPG Industries, Inc., Pittsburgh, Pa.

[21] Appl. No.: 08/914,603

[22] Filed: Aug. 18, 1997

[51] Int. Cl.[6] ..... C25B 7/00; C25B 9/00; C25B 3/00; C25B 1/00

[52] U.S. Cl. ..... 204/539; 204/541; 204/630; 204/252; 204/253; 204/258; 204/265; 205/431; 205/551; 205/552; 205/338; 205/349

[58] Field of Search ..... 204/539, 541, 204/630, 252, 253, 258, 265; 205/431, 551, 552, 338, 349

[56] References Cited

U.S. PATENT DOCUMENTS

| | | | |
|---|---|---|---|
| Re. 32,398 | 4/1987 | De Witt et al. | 204/72 |
| 596,157 | 12/1897 | Hargreaves | 205/480 |
| 791,194 | 5/1905 | Hoopes | 205/552 |
| 2,049,467 | 8/1936 | Mnookin | 260/127 |
| 2,209,681 | 7/1940 | Kokatnur et al. | 204/9 |
| 2,737,486 | 3/1956 | Bodamer | 204/72 |
| 2,760,979 | 8/1956 | Burghausen | 260/585 |
| 2,769,841 | 11/1956 | Dylewski et al. | 260/585 |
| 3,183,269 | 5/1965 | Costabello et al. | 260/585 |
| 3,202,713 | 8/1965 | Marullo et al. | 260/583 |
| 3,337,630 | 8/1967 | Moke et al. | 260/583 |
| 3,484,488 | 12/1969 | Lichtenwalter et al. | 260/585 |
| 3,862,234 | 1/1975 | Steele | 260/585 A |
| 4,425,202 | 1/1984 | Sullivan | 204/72 |
| 4,521,285 | 6/1985 | De Witt et al. | 204/72 |
| 4,561,945 | 12/1985 | Coker et al. | 204/98 |
| 4,582,937 | 4/1986 | Hiraga et al. | 564/498 |
| 4,645,579 | 2/1987 | Weiss et al. | 204/182.4 |
| 4,918,233 | 4/1990 | Deeba et al. | 564/479 |
| 4,980,507 | 12/1990 | Mizui et al. | 564/482 |
| 5,084,148 | 1/1992 | Kazcur et al. | 204/95 |
| 5,198,095 | 3/1993 | Urakawa et al. | 205/138 |
| 5,246,551 | 9/1993 | Pletcher et al. | 204/96 |
| 5,281,311 | 1/1994 | Sharifian et al. | 204/101 |
| 5,290,404 | 3/1994 | Toomey | 204/72 |
| 5,389,211 | 2/1995 | Sharifian et al. | 204/72 |
| 5,411,641 | 5/1995 | Trainham, III et al. | 204/59 R |
| 5,575,901 | 11/1996 | Hulme | 205/413 |
| 5,643,430 | 7/1997 | Gorzysnki | 204/523 |
| 5,665,220 | 9/1997 | Sharma | 205/359 |

FOREIGN PATENT DOCUMENTS

WO93/00460 1/1993 WIPO .

OTHER PUBLICATIONS

Hyrdina# Membrane Electrolyzers Product Brochure, De Nora Permelec S.p.A., Milano, Italy, no date available.

*Encyclopedia of Chemical Technology*, Kirk–Othmer, Fourth Ed., vol. 8, John Wiley & Sons, Inc., New York (1993), pp. 74—108, no month available.

*Primary Examiner*—Kathryn Gorgos
*Assistant Examiner*—Edna Wong
*Attorney, Agent, or Firm*—Irwin M. Stein; James R. Franks

[57] ABSTRACT

Describes a method of electrochemically converting amine hydrohalide, e.g., ethyleneamine hydrochloride, into free amine, e.g., free ethyleneamine. A three compartment electrolytic cell is provided having (1) a catholyte compartment containing a cathode assembly comprising a cathode and an anion exchange membrane, (2) an anode compartment containing an anode assembly comprising either (a) a hydrogen consuming gas diffusion anode and a current collecting electrode or (b) a hydrogen consuming gas diffusion anode which is fixedly held between a hydraulic barrier and a current collecting electrode, and (3) an intermediate compartment separated from the catholyte and anode compartments by the anion exchange membrane and either (i) the hydrogen consuming gas diffusion anode or (ii) the hydraulic barrier respectively. An aqueous solution of amine hydrohalide is charged to the catholyte compartment, while hydrogen gas is charged to the anode compartment and an aqueous conductive electrolyte solution is charged to the intermediate compartment. Direct current is passed through the electrolytic cell and an aqueous solution comprising free amine is removed from the catholyte compartment.

22 Claims, 4 Drawing Sheets

METHOD OF CONVERTING AMINE HYDROHALIDE INTO FREE AMINE

DESCRIPTION OF THE INVENTION

The present invention relates to a method of electrochemically converting amine hydrohalide into free amine. Particularly the present invention relates to an electrochemical method of converting ethyleneamine hydrohalides, and more particularly ethyleneamine hydrochlorides, into free ethyleneamines. The present invention also relates to electrolytic cells having an intermediate compartment separated from a catholyte compartment by an anion exchange membrane and from an anode compartment by either a hydraulic barrier or a hydrogen consuming gas diffusion anode.

A major commercial method of producing free amines, particularly free alkyleneamines, and more particularly free ethyleneamines, involves the reaction of a 1,2-dihaloethane, e.g., 1,2-dichloroethane (EDC), with ammonia to produce the entire family of ethyleneamines, including: ethylenediamine (EDA) , diethylenetriamine (DETA), triethylenetetramine (TETA), tetraethylenepentamine (TEPA), pentaethylenehexamine (PEHA), piperazine, i.e., diethylenediamine (DEDA), and 2-amino-1-ethylpiperazine. The reaction of EDC and ammonia is well known and is described in U.S. Pat. Nos. 2,049,467, 2,760,979, 2,769,841, 3,183,269, 3,484,488, and 4,980,507.

When the 1,2-dihaloethane reactant is 1,2-dichloroethane, the ethyleneamines are produced as their hydrochloride salts which are subsequently neutralized, typically with an aqueous alkali metal hydroxide, e.g., sodium hydroxide. The neutralization reaction results in the formation of a mixture of free ethyleneamines and by-product alkali metal halide salt, e.g., sodium chloride. The by-product alkali metal halide is typically separated from the mixture of free ethyleneamines by an evaporative or distillation process. The mixture of free ethyleneamines is further separated into its individual components by fractional distillation. The presence of halide anion, e.g., chloride anion, in the free ethyleneamines requires that the distillation column(s) be fabricated from expensive corrosion resistant materials, such as titanium and stainless steel. The waste water resulting from the distillation process is typically treated further for the removal of trace amounts of amines prior to disposal. The formation of ethyleneamines from the treatment of ethyleneamine hydrochlorides with an alkali metal hydroxide, e.g., sodium hydroxide, is described in U.S. Pat. Nos. 3,202,713, 3,862,234, 3,337,630, and 4,582,937.

The commercial method described above can be expensive, particularly with regard to the cost of distillation equipment, utility costs, raw material costs, and the required treatment of waste streams. As a result, such commercial method is typically dedicated to relatively high volume production of free amines, can be expensive to expand, and may not be cost effective for relatively low volume production of free amines.

International patent publication WO 93/00460 describes an apparatus and process for electrochemically decomposing salt solutions to form the relevant base and acid, and relates to an electrolyzer comprising at least one elementary cell equipped with a novel hydrogen-depolarized anode assembly. The hydrogen depolarized anode assembly comprises a cation-exchange membrane, an electrocatalytic sheet and a rigid current collector which provides a multiplicity of contact points with the electrocatalytic sheet. The electrolyzer described has a cathodic compartment, a hydrogen gas chamber, and a central compartment separated from the cathodic compartment and the hydrogen gas chamber by cation exchange membranes.

U.S. Pat. No. 4,561,945 describes a process for producing sulfuric acid and caustic soda by the electrolysis of an alkali metal sulfate in a membrane cell having a hydrogen depolarized anode. An electrolysis cell having an anode chamber, a cathode chamber, and a central or buffer chamber, which is separated from the anode and cathode chambers by cation exchange membranes is described.

Because of the drawbacks of current commercial methods, alternative methods for producing free amines, e.g., free ethyleneamines, that are lower in cost with regard to capital investment for equipment, raw material costs, and costs for the treatment of waste streams are continually being sought.

It has now been discovered that amine hydrohalides can be electrochemically converted to free amines using a three compartment electrolytic cell in which the intermediate compartment is separated from the catholyte compartment by an anion exchange membrane, and is separated from the anode compartment by either a hydraulic barrier or a hydrogen consuming gas diffusion anode. The hydrogen consuming gas diffusion anode is either (a) fixedly held between a hydraulic barrier and a current collecting electrode or (b) alone in contact with the current collecting electrode.

In accordance with an embodiment of the present invention, there is provided a method of converting amine hydrohalide into free amine comprising:

(a) providing an electrolytic cell having a catholyte compartment containing a cathode assembly; an anode compartment containing an anode assembly; and an intermediate compartment separating the catholyte and anode compartments; the cathode assembly comprising a cathode and an anion exchange membrane, the anode assembly comprising a hydrogen consuming gas diffusion anode and a current collecting electrode, the intermediate compartment being separated from the catholyte and the anode compartments by the anion exchange membrane and the hydrogen consuming gas diffusion anode;

(b) introducing an aqueous solution of amine hydrohalide into the catholyte compartment;

(c) introducing hydrogen gas into the anode compartment;

(d) introducing an aqueous conductive electrolyte solution into the intermediate compartment;

(e) passing direct current through the electrolytic cell; and (f) removing an aqueous solution comprising free amine from the catholyte compartment.

In accordance with another embodiment of the present invention, there is provided a method of converting amine hydrohalide into free amine as recited above wherein the anode assembly further comprises a hydraulic barrier, the hydrogen consuming gas diffusion anode being fixedly held between the hydraulic barrier and the current collecting electrode, and the intermediate compartment is separated from the anode compartment by the hydraulic barrier.

In accordance with a further embodiment of the present invention, there is provided an electrolytic cell comprising: a catholyte compartment containing a cathode assembly; an anode compartment containing an anode assembly; and an intermediate compartment separating the catholyte and anode compartments; the cathode assembly comprising a cathode and an anion exchange membrane, the anode assembly comprising a hydrogen consuming gas diffusion anode and a current collecting electrode, the intermediate compartment being separated from the catholyte and the anode compartments by the anion exchange membrane and the hydrogen consuming gas diffusion anode.

In accordance with yet a further embodiment of the present invention, there is provided an electrolytic cell as recited above wherein the anode assembly further comprises a hydraulic barrier, the hydrogen consuming gas diffusion anode being fixedly held between the hydraulic barrier and the current collecting electrode, and the intermediate compartment is separated from the anode compartment by the hydraulic barrier.

The features that characterize the present invention are pointed out with particularity in the claims which are annexed to and form a part of this disclosure. These and other features of the invention, its operating advantages and the specific objects obtained by its use will be more fully understood from the following detailed description and the accompanying drawings in which preferred embodiments of the invention are illustrated and described.

Other than in the operating examples, or where otherwise indicated, all numbers expressing quantities of ingredients or reaction conditions used in the specification and claims are to be understood as modified in all instances by the term about.

BRIEF DESCRIPTION OF THE DRAWINGS

In FIGS. 1–4, like reference numerals represent the same structural parts, the same process streams and the same conduits.

DETAILED DESCRIPTION OF THE INVENTION

Figure 1:
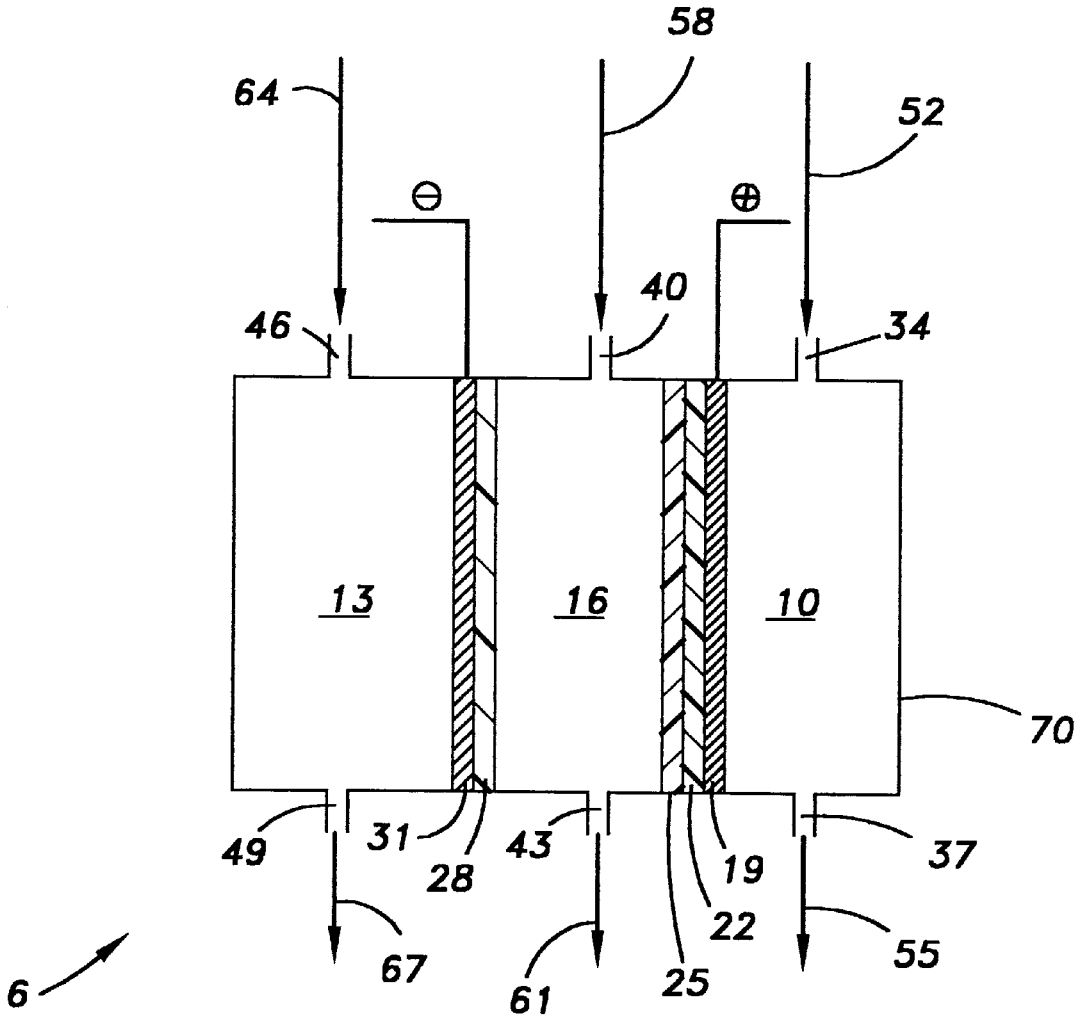
FIG. 1 is a schematic representation of an electrolytic cell useful for converting amine hydrohalide into free amine in accordance with an embodiment of the method of the present invention.

In the practice of the present invention, electrolytic cells, such as those represented in FIGS. 1 through 4, are provided for the conversion of amine hydrohalide to free amine. Referring now to FIG. 1, electrolytic cell 6 comprises a housing 70 having therein a catholyte compartment 13, an anode compartment 10, and an intermediate compartment 16. The catholyte compartment 13 has an inlet 46 and an outlet 49, and also has therein a cathode assembly comprising a cathode 31, which is substantially rigid and provides support for anion exchange membrane 28. The anode compartment has an inlet 34 and an outlet 37, and also has therein an anode assembly comprising a hydrogen consuming gas diffusion anode 22 which is fixedly held between current collecting electrode 19 and hydraulic barrier 25. The intermediate compartment 16 has an inlet 40 and an outlet 43 and is separated from the catholyte compartment 13 by anion exchange membrane 28, and from the anode compartment 10 by hydraulic barrier 25, more particularly, the anode assembly.

The electrolytic cells of FIGS. 1–4 may be assembled by any appropriate method as long as the basic structural arrangements of component parts, as depicted in FIGS. 1–4, are maintained. For example, the catholyte, anode and intermediate compartments may each be fabricated separately and then assembled by clamping or otherwise fastening the compartments together.

Housing 70 may be fabricated from any of the known conventional materials for electrolytic cells, or combinations of these known materials, that are preferably at least corrosion resistant to, and compatible with the materials being circulated through the catholyte, anode and intermediate compartments or formed in these compartments. Examples of materials from which housing 70 may be fabricated include, but are not limited to: metal, e.g., stainless steel, titanium and nickel; and plastics, e.g., poly (vinylidenefluoride), polytetrafluoroethylene which is sold under the trademark "TEFLON", and which is commercially available from E. I. du Pont de Nemours and Company of Wilmington, Del., glass filled polytetrafluoroethylene, polypropylene, polyvinylchloride, chlorinated polyvinylchloride and high density polyethylene. Preferred materials from which the housing 70 may be fabricated include: poly(vinylidenefluoride) and stainless steel.

If housing 70 is fabricated from an electrically conductive material, such as stainless steel, then appropriately positioned nonconductive gaskets would typically also be present as is known to those of ordinary skill in the art. For example, if the various compartments of the cell are prefabricated separately from stainless steel, such gaskets would typically be placed between those portions of the prefabricated compartments that would otherwise abut each other upon assemblage of the electrolytic cell. Such nonconductive gaskets may be fabricated from synthetic polymeric materials, e.g., copolymers of ethylene and propylene, and fluorinated polymers.

Cathode 31 and current collecting electrode 19 each may be fabricated from any appropriate material that is at least both corrosion resistant to the environments to which they are exposed and electrically conductive. In electrolytic cells 6 and 3, it is also desirable that cathode 31 and current collecting electrode 19 be substantially rigid so as to provide support for, respectively, anion exchange membrane 28, and either hydrogen consuming gas diffusion anode 22 alone or the combination of hydrogen consuming gas diffusion anode 22 and hydraulic barrier 25. Materials from which cathode 31 and current collecting electrode 19 may be fabricated include, but are not limited to: graphite; platinum; titanium coated with platinum; titanium coated with an oxide of ruthenium; nickel; stainless steel; specialty steels including high alloy steels containing nickel, chromium, and molybdenum, e.g., HASTELLOY® C-2000™ alloy and HASTELLOY® C-276™ alloy from Haynes International, Inc. While current collecting electrode 19 may be fabricated from stainless steel, it is preferred to use a more corrosion resistant material such as a high alloy steel, e.g., HASTELLOY® C-2000™ alloy. Cathode 31 and current collecting electrode 19 may each be comprised of a material selected from the group consisting of graphite, platinum, titanium coated with platinum, titanium coated with an oxide of ruthenium, nickel, stainless steel, high alloy steel and appropriate combinations of such materials.

Preferably both cathode 31 and current collecting electrode 19 have a perforated or mesh-like configuration. A perforated or mesh-like configuration provides for increased cathode and electrode surface area, and minimizes interference with the movement of ions across the anion exchange membrane, the hydrogen consuming gas diffusion anode and also the hydraulic barrier.

The anion exchange membrane 28 used in the practice of the present invention can be prepared from any appropriate material that is permeable to and capable of transferring anions. Typically, such anion exchange membranes are comprised of commercially available organic polymers, often thermoplastic polymers, containing weakly basic pendant polar groups. The membranes may comprise polymers based on fluorocarbons, polystyrene, polypropylene, polybutadiene, polyisoprene, polyisobutylene, polyethylene and hydrogenated styrene/butadiene block copolymers. For example, one such representative anion exchange membrane comprises polystyrene which has dialkylamino groups that have been converted into quaternary ammonium ions covalently bonded to at least some of the benzene rings of the polystyrene backbone. It is preferable that the anion exchange membrane also be physically durable and stable towards exposure to acids, in particular hydrogen halides, e.g., hydrogen chloride.

A particular example of an anion exchange membrane used in the practice of the present invention is a copolymer of styrene and divinylbenzene which contains from 4 percent (%) to 16%, typically from 6% to 8%, by weight of divinylbenzene and also quaternary ammonium groups as anion carriers. Such membranes are available commercially under the trade designation RAIPORE® from RAI Research Corporation, and TOSFLEX® from Tosoh Corporation. Other suitable membranes include, but are not limited to: NEOSEPTA® membranes from Tokyuama Soda; SELEMION membranes from Asahi Glass; and IONAC MA 3148, MA 3236 and MA 3457 (based on a polymer of heterogeneous polyvinyl chloride substituted with quaternary ammonium groups) membranes from Ritter-Pfaulder Corporation. Particularly preferred anion exchange membranes are NEOSEPTA® ACM and NEOSEPTA® AHA-2 membranes, available commercially from Tokuyama Soda of Japan, which are described as being comprised of a copolymer of styrene and divinylbenzene having pendent quaternary ammonium groups.

In the practice of the method of the present invention, it is preferred that the hydraulic barrier 25 prevent substantially the flow of liquid and hydrogen gas between intermediate compartment 16 and anode compartment 10, while also being permeable to hydrogen cations. The hydraulic barrier 25 may be, for example, a cation exchange membrane or a microporous film.

When hydraulic barrier 25 is a cation exchange membrane, it may be fabricated of any appropriate material that is also materials from which such cation exchange membrane may be fabricated include, but are not limited to, organic polymers, in particular synthetic organic polymers, and ceramics, e.g., beta-alumina. The use of synthetic organic polymers having pendent acidic groups is preferred, many of which are commercially available or can be made according to art-recognized methods. A preferred class of synthetic organic polymers are fluoropolymers, more preferably perfluoropolymers, and in particular copolymers comprised of two or more fluoromonomers or perfluoromonomers, having pendent acid groups, preferably pendent sulfonic acid groups.

When the cation exchange membrane hydraulic barrier is fabricated from fluorinated polymer(s) or copolymer(s), the pendent acid groups may include the following representative general formulas: $—CF_2CF\ (R)\ SO_3H$; and $—OCF_2CF_2CF_2SO_3H$, where R is a F, Cl, $CF_2Cl$, or a $C_1$ to $C_{10}$ perfluoralkyl radical. The synthetic organic polymer of the cation exchange membrane may, for example, be a copolymer of ethylene and a perfluorinated monomer as represented by the following general formula, $CF_2{=}CFOCF_2CF(CF_3)OCF_2CF_2SO_3H$. These copolymers may have pendent sulfonyl fluoride groups ($—SO_2F$), rather than pendent sulfonic acid groups ($—SO_3H$) . The sulfonyl fluoride groups ($—SO_2F$) can be reacted with potassium hydroxide to form $—SO_3K$ groups, which can then be reacted with an acid to form sulfonic acid groups $—SO_3H$.

Suitable cation exchange membranes comprised of copolymers of polytetrafluoroethylene and poly-sulfonyl fluoride vinyl ether-containing pendant sulfonic acid groups are offered by E. I. du Pont de Nemours and Company of Wilmington, Del. under the tradename "NAFION" (hereinafter referred to as NAFION®). In particular, NAFION® membranes containing pendant sulfonic acid groups include NAFION® 117, NAFION® 324 and NAFION® 417 membranes. The NAFION® 117 membrane is described as an unsupported membrane having an equivalent weight of 1100 grams per equivalent (g/eq), equivalent weight being here defined as that amount of resin required to neutralize one liter of a 1 Molar (M) sodium hydroxide solution. The NAFION® 324 and NAFION® 417 membranes are described as being supported on a fluorocarbon fabric. The NAFION® 417 membrane has an equivalent weight of 1100 g/eq. The NAFION® 324 membrane is described as having a two-layer structure comprised of: a 125 micrometer ($\mu$m) thick membrane having an equivalent weight of 1100 g/eq; and a 25 $\mu$m thick membrane having an equivalent weight of 1500 g/eq.

While the use of cation exchange membranes based on synthetic organic polymers are preferred as hydraulic barriers, it is within the scope of the practice of the method of the present invention to use other cation-transporting membranes which are not polymeric. For example, solid state proton conducting ceramics such as beta-alumina may be used. Examples of representative solid proton conductors that may be used are listed in columns 6 and 7 of U.S. Pat. No. 5,411,641 and are incorporated herein by reference.

Hydraulic barrier 25 may also be a microporous film. Microporous films are known and can be described as being heterogeneous structures having a solid phase containing voids. Microporous films useful in the present invention are preferably permeable to hydrogen cations and prevent substantially the flow of liquid and hydrogen gas between intermediate compartment 16 and anode compartment 10. Suitable microporous films may be comprised of synthetic organic polymers such as polypropylene or polysulfone. An example of a commercially available microporous film useful in the practice of the method of the present invention is available under the tradename CELGARD® from Hoechst-Celanese Corp.

Hydrogen consuming gas diffusion anode 22 may be fabricated from any suitable material or combination of materials which provides an electrochemically active surface upon which hydrogen gas ($H_2$) can be converted to the hydrogen cation ($H^+$), through which hydrogen cations may diffuse, and which is also semihydrophobic. By semihydrophobic is meant that an aqueous liquid can penetrate the anode without flooding it, i.e., without preventing the electrochemical conversion of hydrogen gas to hydrogen cation. The electrochemical activity is typically provided by a catalytic material. Examples of suitable catalytic materials include, but are not limited to, platinum, ruthenium, osmium, rhenium, rhodium, iridium, palladium, tungsten carbide, gold, titanium, zirconium, alloys of these with non-noble metals and appropriate combinations thereof.

The hydrogen consuming gas diffusion anode 22 used in the practice of the present invention is preferably comprised of platinum, e.g., platinum supported on carbon, preferably hydrophilic carbon, or finely powdered platinum (platinum black), which has been dispersed in a polymer matrix. Examples of useful polymer matrices include fluorinated and perfluorinated polymers. A preferred polymer in which platinum supported on hydrophilic carbon may be dispersed is polytetrafluoroethylene. The hydrogen consuming gas diffusion anode 22 may be comprised of from 0.1 milligrams platinum per square centimeter of the surface area of the hydrogen consuming gas diffusion anode ($mg/cm^2$) to 15 $mg/cm^2$, preferably from 0.5 $mg/cm^2$ to 10 $mg/cm^2$, and more preferably from 0.5 $mg/cm^2$ to 6 $mg/cm^2$.

The method of the present invention may also be practiced using an electrolytic cell in which the anode assembly comprises hydrogen consuming gas diffusion anode 22 and current collecting electrode 19, wherein intermediate compartment 16 is separated from anode compartment 10 by the hydrogen consuming gas diffusion anode 22. Such a cell is represented as electrolytic cell 3 in FIG. 4. In addition to the properties previously recited, it is desirable that the hydrogen consuming gas diffusion anode 22 of electrolytic cell 3 also prevent substantially the flow of hydrogen gas and aqueous liquid between intermediate compartment 16 and anode compartment 10.

Within anode compartment 10 of electrolytic cells 6 and 3, the method by which the anode assembly is held together may be achieved by any appropriate means. Such methods include, but are not limited to: maintaining a higher internal pressure within intermediate compartment 16 relative to catholyte compartment 13 and anode compartment 10; clamping components, 25, 22 and 19, or 22 and 19 together; providing a biasing element within at least the intermediate compartment, e.g., an electrically nonconductive plastic spring, not shown, can be placed within intermediate compartment 16 such that it is in biased contact with anion exchange membrane 28 and either hydraulic barrier 25 or hydrogen consuming gas diffusion anode 22; and combinations of these methods.

In one embodiment of the present invention the hydrogen consuming gas diffusion anode 22 is hot-pressed onto one side of the hydraulic barrier 25. In another embodiment of the present invention, hydrogen consuming gas diffusion anode 22 is simply placed between hydraulic barrier 25 and current collecting electrode 19 prior to assembly of the electrolytic cell. In yet another embodiment of the present invention, carbon cloth or carbon paper, not shown, is placed between hydrogen consuming gas diffusion anode 22 and current collecting electrode 19 to provide additional support for the hydrogen consuming gas diffusion anode. The carbon cloth and carbon paper are both preferably semihydrophobic, e.g., treated with TEFLON® polytetrafluoroethylene prior to use. Optionally, the carbon cloth and carbon paper may also be impregnated with a catalytic material, such as platinum.

Ensuring that electrical contact exists between hydrogen consuming gas diffusion anode 22 and electrode 19 is important in the practice of the present invention. This is the case when the anode assembly is comprised of either (a) the hydrogen consuming gas diffusion anode 22 fixedly held between hydraulic barrier 25 and current collecting electrode 19, or (b) the hydrogen consuming gas diffusion anode 22 and current collecting electrode 19. In one embodiment of the present invention, electrical contact is maintained between the hydrogen consuming gas diffusion anode 22 and the current collecting electrode 19 by ensuring that a positive internal pressure difference exists between at least the intermediate and anode compartments. By positive internal pressure difference is here meant that intermediate compartment 16 has an internal pressure greater than that of anode compartment 10. In this case, the positive internal pressure difference value is determined by subtracting the internal pressure of anode compartment 10 from that of intermediate compartment 16. While the practice of the present invention allows for the internal pressure difference between intermediate compartment 16 and catholyte compartment 13 to be essentially zero, it is preferable that the intermediate compartment 16 have an internal pressure greater than that of catholyte compartment 13.

The upper limit of the positive internal pressure difference between the intermediate compartment 16 and each of the catholyte and anode compartments will depend on a number of factors including, for example, the maximum pressure that the anion exchange membrane, hydraulic barrier, and hydrogen consuming gas diffusion anode can each endure before they burst. In the practice of the method of the present invention, the positive internal pressure difference between the intermediate compartment 16 and each of catholyte compartment 13 and anode compartment 10 typically has a minimum value of at least 0.07 Kilograms per square centimeter ($Kg/cm^2$) (1 pound per square inch (psi)), preferably at least 0.14 $Kg/cm^2$ (2 psi), and more preferably at least 0.21 $Kg/cm^2$ (3 psi). The positive internal pressure difference between the intermediate compartment 16 and each of catholyte compartment 13 and anode compartment 10 will also typically have a maximum value of less than 1.40 $Kg/cm^2$ (20 psi), preferably less than 0.70 $Kg/cm^2$ (10 psi), and more preferably less than 0.49 $Kg/cm^2$ (7 psi). In the practice of the method of the present invention, the positive internal pressure difference between the intermediate compartment 16 and each of catholyte compartment 13 and anode compartment 10 may range between any combination of these minimum and maximum values, inclusive of the recited values.

The present invention relates to a method of converting amine hydrohalide into free amine. As used herein, the term "halide" is meant to include chloride, bromide and iodide. Amines that may be prepared from their corresponding amine hydrohalides according to the method of the present invention include, but are not limited to: ammonia; mono alkyl, e.g., $C_1$–$C_{12}$ alkyl, amines, di- and tri-substituted alkyl, e.g., $C_1$–$C_{12}$ alkyl, amines, in which the alkyl groups may be the same or different, saturated or unsaturated, examples of saturated alkyl groups include, but are not limited to, methyl, ethyl, isopropyl, n-butyl, tert-butyl, amyl and dodecyl, examples of unsaturated alkyl groups, include, but are not limited to, allyl and methallyl; one or more amines belonging to the family of ethyleneamines, including, ethylenediamine (EDA), diethylenetriamine (DETA), triethylenetetramine (TETA), tetraethylenepentamine (TEPA), pentaethylenehexamine (PEHA), piperazine (DEDA), and 2-amino-1-ethylpiperazine; alkyl, e.g., $C_1$–$C_2$ alkyl, ethylenediamines, e.g., N-ethylethylenediamine, N,N-dimethylethylenediamine, N,N'-dimethylethylenediamine, N,N-diethylethylenediamine, N,N'-diethylethylenediamine, N,N-dimethyl-N'-ethylethylenediamine, and N,N,N',N'-tetramethylethylenediamine; propylenediamines, e.g., 1,2-propylenediamine, and 1,3-propylenediamine; alkyl, e.g., $C_1$–$C_3$ alkyl, propylenediamines, e.g., N-methyl-1,3-propylenediamine; alkanolamines, e.g., mono-, di- and tri (2-hydroxyethyl)amine; alkylamino alkanols, e.g., $C_1$–$C_6$ alkylamino $C_1$–$C_{12}$ alkanols, e.g., 2-(ethylamino)ethanol, and 2-(diethylamino)ethanol; $C_5$–$C_7$ cycloaliphatic amines, e.g., cyclohexylamine, N-methylcyclohexylamine, and 1,4-diazobicyclo[2.2.2]octane; and aromatic amines, e.g., aniline, N-ethylaniline, and N,N-diethylaniline.

As used herein, the term "ethyleneamine" is meant to refer to one or more amines belonging to the family of ethyleneamines as previously recited. In a preferred embodiment of the present invention, the amine hydrohalide is an amine hydrochloride, and the amine of the amine hydrochloride is selected from the group consisting of ammonia, monoalkylamines, dialkylamines, trialkylamines, ethyleneamines, alkyl ethylenediamines, propylenediamines, alkyl propylenediamines, monoalkanolamines, dialkanolamines, trialkanolamines, cycloaliphatic amines, aromatic amines, and mixtures of such amines, as described previously. In a particularly preferred embodiment of the present invention, the amine of the amine hydrochloride is an "ethyleneamine" and is selected from the group consisting of ethylenediamine, diethylenetriamine, triethylenetetramine, tetraethylenepentamine, pentaethylenehexamine, piperazine, 1-(2-aminoethyl)piperazine and mixtures of such ethyleneamines.

The operation of the electrolytic cell 6 of FIGS. 1, 2, and 3 will now be described as it relates to preferred embodiments of the process of the present invention. An aqueous solution of amine hydrohalide is circulated through catholyte compartment 13 by forwarding the solution from a source of amine hydrohalide, e.g., temperature controlled reservoir 75 shown in FIGS. 2 and 3, through a suitable conduit (shown by line 64); introducing the solution into catholyte compartment 13 through inlet 46; withdrawing a process stream comprising free amine and amine hydrohalide from catholyte compartment 13 through outlet 49; and forwarding that process stream by a suitable conduit (shown by line 67) to the source of amine hydrohalide, e.g., reservoir 75.

The temperature at which the aqueous solution of amine hydrohalide is maintained depends on, for example, its boiling point and the operating temperature limits of the anion exchange membrane 28. In the practice of the present invention, the aqueous solution of amine hydrohalide is typically maintained at a minimum temperature of at least 25° C., preferably at least 30° C., and more preferably at least 40° C. The aqueous solution of amine hydrohalide is also typically maintained at a maximum temperature of less than 70° C., preferably less than 65° C., and more preferably less than 60° C. The temperature at which the aqueous solution of amine hydrohalide is maintained may range between any combination of these minimum and maximum temperature values, inclusive of the recited values.

The aqueous solution of amine hydrohalide typically contains amine hydrohalide present in an amount of at least 5% by weight, preferably at least 10% by weight, and more preferably at least 25% by weight, based on the total weight of the aqueous solution of amine hydrohalide. The aqueous solution of amine hydrohalide also typically contains amine hydrohalide present in an amount of not more than 50% by weight, preferably not more than 40% by weight, and more preferably not more than 35% by weight, based on the total weight of the aqueous solution of amine hydrohalide. The amount of amine hydrohalide present in the aqueous solution of amine hydrohalide may range between any combination of these amounts, inclusive of the recited amounts.

Figure 2:
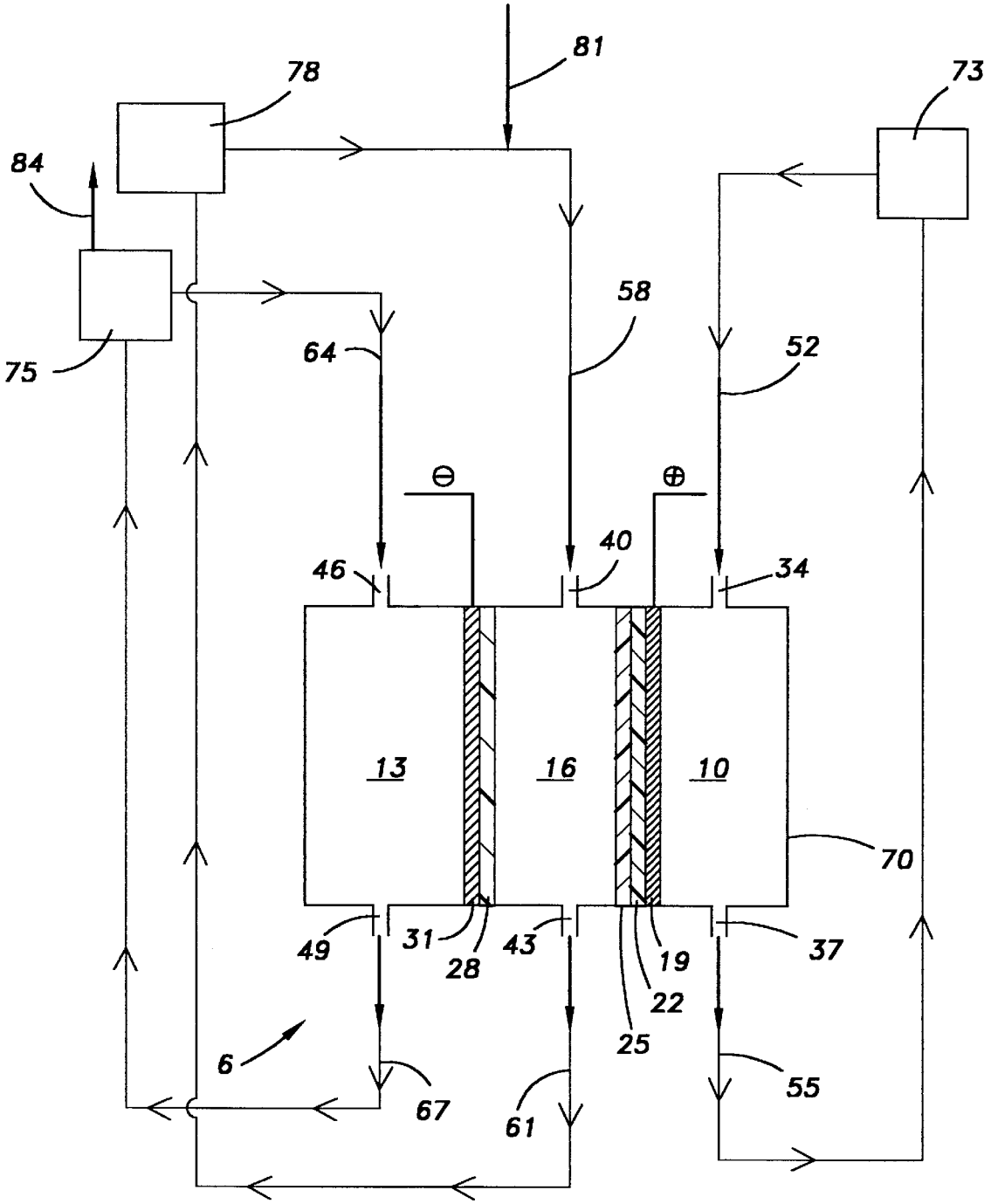
FIG. 2 is a schematic of the electrolytic cell depicted in FIG. 1 further illustrating the flow of circulating process streams around the catholyte, anode and intermediate compartments.
Figure 3:
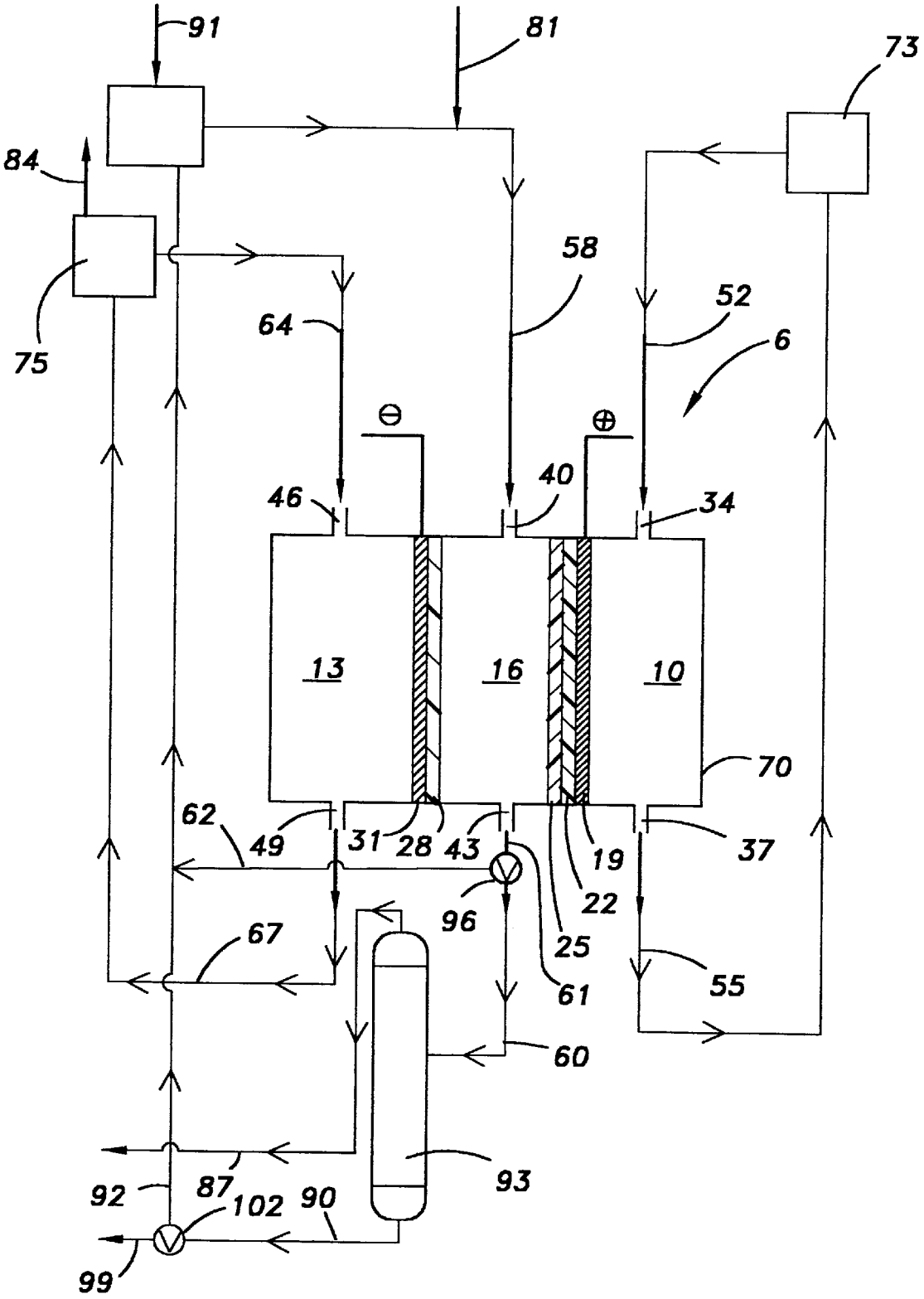
FIG. 3 is a schematic of the electrolytic cell depicted in FIG. 2 further illustrating the treatment of a process stream removed from the intermediate compartment.
Figure 4:
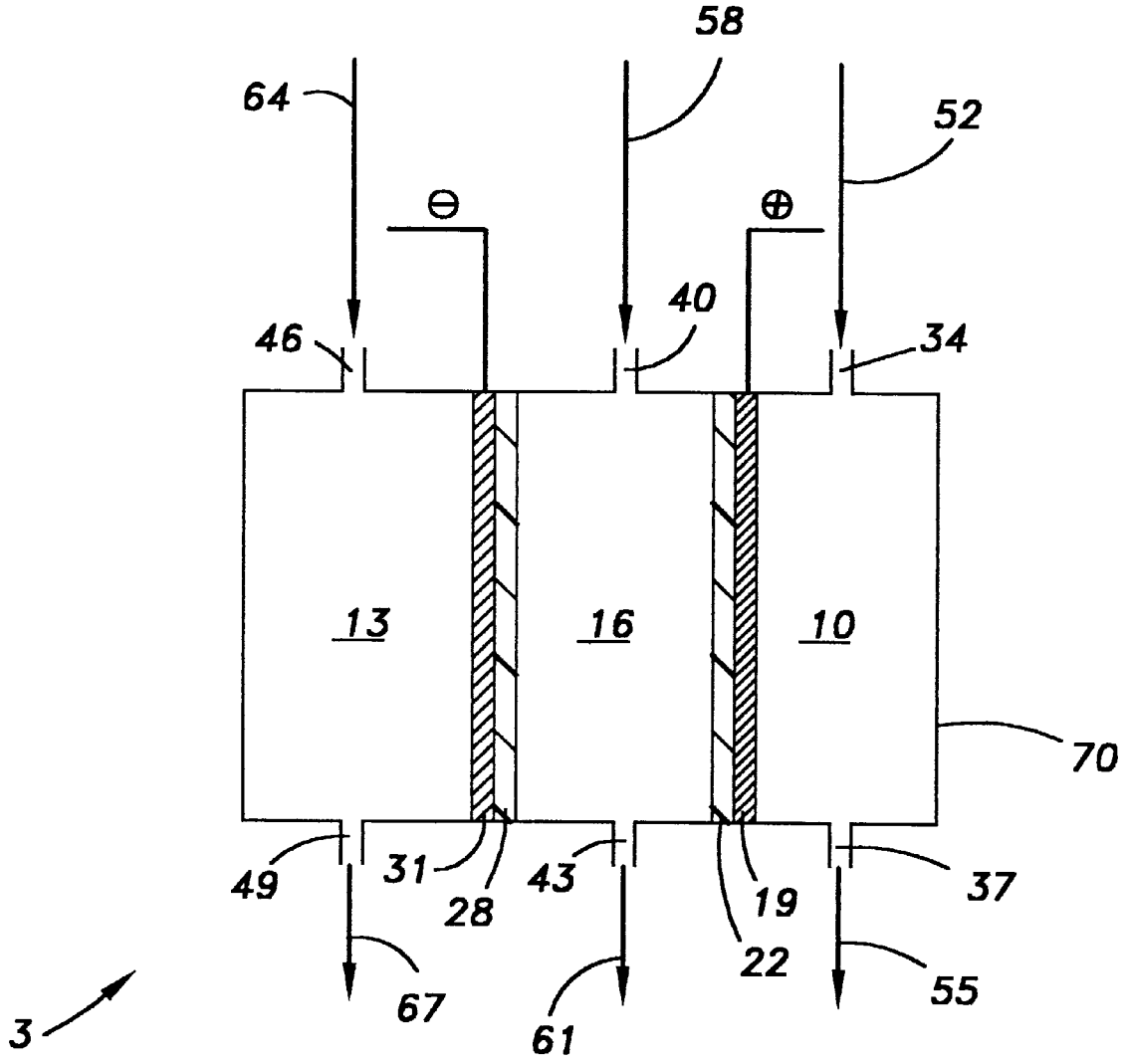
FIG. 4 is a schematic of an electrolytic cell similar to the electrolytic cell of FIG. 1, but in which the hydraulic barrier is not present.

Similarly and simultaneously with the circulation of aqueous solution of amine hydrohalide through catholyte compartment 13, in connection with electrolytic cell 6, hydrogen gas is circulated through anode compartment 10 by forwarding hydrogen gas from a source of hydrogen, e.g., reservoir 73 shown in FIGS. 2 and 3, through a suitable conduit or transfer line (shown by line 52); introducing such hydrogen gas into anode compartment 10 through inlet 34; withdrawing hydrogen gas from anode compartment 10 through outlet 37; and forwarding withdrawn hydrogen gas by a suitable conduit or transfer line (shown by line 55) to the source of hydrogen, e.g., reservoir 73. Other gas(es) may be present with the hydrogen gas circulated through anode compartment 10, e.g., nitrogen, as long as such other gas(es) do not adversely affect the operation of the electrolytic cell. In particular, it is preferred that the hydrogen gas-containing stream be substantially free of carbon monoxide (CO) as carbon monoxide can poison or otherwise degrade the hydrogen consuming gas diffusion anode 22.

Contemporaneously and in a manner similar to the circulation of the respective process streams through each of the catholyte and anode compartments, an aqueous conductive electrolyte solution is circulated through intermediate compartment 16 by forwarding the electrolyte solution from a source of electrolyte solution, e.g., temperature controlled reservoir 78 shown in FIGS. 2 and 3, through a suitable conduit (shown by line 58); introducing the electrolyte solution into intermediate compartment 16 through inlet 40; withdrawing a process stream comprising the electrolyte solution from intermediate compartment 16 through outlet 43; and forwarding that process stream by a suitable conduit (shown by line 61) to the source of electrolyte solution, e.g., reservoir 78.

The aqueous conductive electrolyte solution circulated through intermediate compartment 16 is a solution capable of conducting an electric current. The temperature at which the aqueous conductive electrolyte solution is maintained depends on, for example, its boiling point and the operating temperature limits of anion exchange membrane 28 and hydraulic barrier 25. In the practice of the present invention, the aqueous conductive electrolyte solution is typically maintained at a temperature of at least 25° C., preferably at least 30° C., and more preferably at least 40° C. The aqueous conductive electrolyte solution is also typically maintained at a temperature of less than 70° C., preferably less than 65° C., and more preferably less than 60° C. The temperature at which the aqueous conductive electrolyte solution is maintained may range between any combination of these temperatures, inclusive of the recited temperatures.

The aqueous conductive electrolyte solution may have present therein hydrogen halide, e.g., hydrogen chloride, and/or an alkali metal halide, e.g., sodium chloride, the halide being the same as that of the amine hydrohalide. In a preferred embodiment of the present invention, the aqueous conductive electrolyte solution is comprised of an aqueous solution of hydrogen chloride, wherein the hydrogen chloride is present in an amount of at least 1 by weight, preferably at least 5% by weight, and more preferably at least 10% by weight, based on the total weight of the aqueous conductive electrolyte solution. The hydrogen chloride is also present in the aqueous conductive electrolyte solution in an amount less than 25% by weight, preferably less than 20% by weight, and more preferably less than 15% by weight, based on the total weight of the aqueous conductive electrolyte solution. The amount of hydrogen chloride present in the aqueous solution of hydrogen chloride may range between any of these values, inclusive of the recited values.

Electrolytic cells 6 and 3 may be operated at a current density of at least 0.05 Kiloamperes per square meter of electrode surface available for electrochemical reaction (Kamps/$m^2$), preferably at least 0.1 Kamps/$m^2$, and more preferably at least 0.2 Kamps/$m^2$. The current density also may be not more than 10 Kamps/$m^2$, preferably not more than 7 Kamps/$m^2$, and more preferably not more than 6 Kamps/$m^2$. In the practice of the method of the present invention, the current density may range between any combination of these values, inclusive of the recited values. The surface area of the electrode being here calculated from its perimeter dimensions alone.

While not meaning to be bound by any theory, it is believed from the evidence at hand that the current passing through electrolytic cells 6 and 3 results in the following chemical and electrochemical reactions. The electrochemical and chemical reactions believed to occur within catholyte compartment 13 may be represented by the following General Scheme I:

General Scheme I $$2e^- + 2H_2O \xrightarrow{\text{Electrical Energy}} H_2\,(g) + 2OH^-$$

$$2BH^+X^- + 2OH^- \longrightarrow 2B + 2H_2O + 2X^-$$

wherein $BH^+X^-$ represents an amine hydrohalide, $X^-$ represents a halide anion, and B represents free amine. The halide anion $X^-$ is selectively transported across anion exchange membrane 28 and passes into intermediate compartment 16. The electrons consumed, as shown in General Scheme I, are provided by cathode 31. Hydrogen gas generated within the catholyte compartment is forwarded along with the circulating amine hydrohalide/free amine process stream to amine hydrohalide reservoir 75 from where it may be recovered by means of conduit 84, as shown in FIGS. 2 and 3. Alternatively, the hydrogen gas removed from reservoir 75 may be forwarded to reservoir 73 by means of a conduit not shown.

Within the anode compartment 10, the following electrochemical reaction is believed to occur as represented by General Scheme II:

General Scheme II $$H_2\,(g) \xrightarrow{\text{Electrical Energy}} 2H^+ + 2e^-$$

Hydrogen cations ($H^+$) produced within and/or on the surface of anode 22 move across hydraulic barrier 25 and pass into intermediate compartment 16, in the case of electrolytic cell 6. In the case of electrolytic cell 3 of FIG. 4, the hydrogen cations diffuse directly through the hydrogen consuming gas diffusion anode 22 into intermediate compartment 16. The electrons generated, as shown in General Scheme II, are transferred by electrical contact from hydrogen consuming gas diffusion anode 22 to current collecting electrode 19. Within intermediate compartment 16, the halide anions ($X^-$) transported across anion exchange membrane 28, and the hydrogen cations ($H^+$) from anode compartment 10, together form hydrogen halide which dissolves in the aqueous conductive electrolyte solution to form aqueous hydrogen halide.

The practice of the method of the present invention includes the step of removing an aqueous solution comprising free amine from catholyte compartment 13, and forwarding this process stream by means of conduit 67 to amine hydrohalide reservoir 75. The process stream withdrawn from catholyte compartment 13 will contain a higher amount of free amine than the process stream entering catholyte compartment 13.

When the concentration of free amine in the process stream circulating through catholyte compartment 13 reaches a desired level, the free amine is recovered from that stream. The aqueous solution from which the free amine is recovered will typically contain an amount of free amine that is at least 50 percent greater than that of the aqueous solution of amine hydrohalide initially charged to catholyte compartment 13. Of the total mole equivalents of amine hydrohalide initially present in the aqueous solution of amine hydrohalide circulated through catholyte compartment 13, at least 50%, preferably at least 80%, and more preferably at least 95% of these equivalents are converted to free amine in accordance with the practice of the method of the present invention.

While a batch process has been described, a continuous process for converting the amine hydrohalide to free amine is contemplated. For example, a side stream of the circulating aqueous stream of amine hydrohalide can be removed to make the process a continuous or semi-continuous process.

In one contemplated embodiment of the present invention, electrolytic cells 6 and 3 are operated until 95% to 99.5%, and preferably 98% to 99.5% of the total mole equivalents of amine hydrohalide initially present in the aqueous solution of amine hydrohalide introduced into catholyte compartment 13 are converted to free amine. To convert the remaining, e.g., 0.5% to 5%, equivalents of unconverted amine hydrohalide to free amine, the aqueous solution comprising free amine removed from catholyte compartment 13 may be treated with a small amount of alkali metal hydroxide, e.g., sodium hydroxide, followed by separation of the resulting alkali metal halide salt, e.g., sodium chloride.

In a modification of the above embodiment, the remaining, e.g., 0.5% to 5%, mole equivalents of unconverted amine hydrohalide are converted to free amine by passing the aqueous solution comprising free amine removed from catholyte compartment 13 through an anion exchange resin, which is contained in one or more anion exchange columns. For example, the removed aqueous solution comprising free amine containing from for example 0.5% to 5% equivalents of unconverted amine hydrohalide, based on the total equivalents of amine hydrohalide initially present in the aqueous solution of amine hydrohalide, is passed through an anion exchange column or a series of anion exchange columns containing anion exchange resins, which exchange hydroxide anions (OH) for halide anions ($X^-$). The hydroxide anions released from the column(s) serve to convert the amine cation ($BH^+$) to free amine (B) and water.

Ion exchange columns useful in the aforedescribed finishing process, are well known and typically are filled with a solid sorbant material comprised of a porous water insoluble synthetic organic polymer having acidic or basic groups, along the polymer backbone (ion exchange resin). Cation exchange resins have acidic groups, while anion exchange resins have basic groups along the polymer backbone. Examples of suitable organic polymers from which the sorbant material may be comprised include, but are not limited to, phenolic based polymers, styrene based polymers and acrylic based polymers. A general illustrative example of an anion exchange resin is polystyrene having either quaternary ammonium groups or tertiary amine groups covalently bonded to at least some of the benzene rings of the polystyrene backbone. An example of an anion exchange resin useful in the practice of the present invention is commercially available under the tradename AMBERJET® 4400 OH resin, from Rohm and Haas Company.

During operation of electrolytic cells 6 and 3, the concentration of hydrogen halide, e.g., hydrogen chloride, within the aqueous conductive electrolyte solution in intermediate compartment 16 will increase with each pass of the circulating solution through intermediate compartment 16. The aqueous hydrogen halide process stream removed from intermediate compartment 16 will contain a higher amount of hydrogen halide than the process stream entering the intermediate compartment by means of conduit 58.

If the concentration of hydrogen halide within intermediate compartment 16 becomes too high, e.g., in excess of 25% by weight in the case of hydrogen chloride, based on the total weight of the aqueous conductive electrolyte solution, the operating efficiency of the electrolytic cell will likely begin to degrade. Examples of degraded operating efficiency include, higher required operating cell potentials and reduced current efficiency resulting from the back migration of protons and halide anions across the anion exchange membrane 28.

FIGS. 2 and 3 each represent separate embodiments of the present invention further comprising the step of maintaining the hydrogen halide concentration of the aqueous conductive electrolyte solution circulated through intermediate compartment 16 at a concentration below 25% by weight, preferably below 20% by weight, and more preferably below 15% by weight, based on the total weight of the aqueous conductive electrolyte solution.

In the particular embodiment represented by FIG. 2, an aqueous stream selected from the group consisting of water, aqueous alkali metal hydroxide, e.g., aqueous sodium hydroxide, and a mixture of aqueous alkali metal hydroxide and alkali metal halide, e.g., a mixture of aqueous sodium hydroxide and sodium chloride, is introduced into intermediate compartment 16. More specifically, this aqueous reagent stream is introduced into the circulating aqueous conductive electrolyte solution through conduit 81 from a source not shown, and the combined streams are then forwarded into intermediate compartment 16 through inlet 40 by means of conduit 58.

Within intermediate compartment 16, the introduced alkali metal hydroxide can combine with hydrogen halide, e.g. hydrogen chloride, to form water and aqueous alkali metal halide, e.g., aqueous sodium chloride, or the introduced water will dilute the aqueous conductive electrolyte solution. The resultant solution exits intermediate compartment 16 through outlet 43 and is forwarded to electrolyte solution reservoir 78 by means of conduit 61. The amount of water/reagent introduced into conduit 58 through conduit 81 can be controlled automatically, for example, through the use of a metering device having a pH feed-back control loop, not shown. Depending on the volume of aqueous process stream added through conduit 81, the volume capacity of reservoir 78 may be exceeded, requiring that some of the combined added aqueous stream and aqueous electrolyte solution be removed, e.g., as a bleed stream, from the circulating solution at a convenient point through a conduit, not shown.

In the embodiment of the invention represented by FIG. 3, the concentration of the hydrogen halide in the aqueous conductive electrolyte solution is maintained below 25% by weight by: distilling the aqueous conductive electrolyte solution removed from the intermediate compartment in distillation column 93; removing concentrated hydrogen halide distillate and bottoms from the distillation column; and either returning the bottoms to the intermediate compartment, e.g., by forwarding the bottoms to reservoir 78, or by introducing either water or an aqueous conductive electrolyte solution having a concentration of hydrogen halide of less than 25% by weight, based on the total weight of the aqueous conductive electrolyte solution, into the intermediate compartment. More specifically, the aqueous conductive electrolyte solution removed from the intermediate compartment 16 either passes (by means of valve 96) into conduit 60 to distillation column 93 or into conduit 62 for recycle to intermediate compartment 16, e.g., through reservoir 78 by means of conduit 92. The aqueous conductive electrolyte solution is distilled in distillation column 93 and a concentrated hydrogen halide distillate and bottoms are removed by means of conduits 87 and 90 respectively. The bottoms may optionally be run through a heat exchanger, not shown, prior to entering valve 102. The valve 102 connecting conduits 90, 92 and 99, may be used to bypass conduit 92 totally or partially by passing all or a portion of the bottoms into conduit 99.

The operation of distillation column 93 results in a reduction in volume of the aqueous conductive electrolyte solution circulated through intermediate compartment 16, in particular when bottoms product is not recycled to the intermediate compartment. As a result, water or an aqueous conductive electrolyte solution having a concentration of hydrogen halide of less than 25% by weight, based on the total weight of the aqueous conductive electrolyte solution, is introduced into intermediate compartment 16 to replenish the reduced volume. As shown in FIG. 3, this can be done by adding make-up water or an aqueous conductive electrolyte solution having a concentration of hydrogen halide of less than 25% by weight, based on the total weight of the aqueous conductive electrolyte solution to reservoir 78 through conduit 91.

Distillation columns are well known and are typically operated under conditions that result in favorable or desirable vapor-liquid equilibria. The temperature and the pressure under which a distillation column is operated can be adjusted together to shift the azeotrope point of the mixture being distilled such that a desired concentration of one or more of the components of the mixture may be retrieved. Depending on the nature of the mixture to be distilled, the distillation column can be of the plate type, e.g., crossflow plate or counterflow plate, or packed type.

In the practice of the present invention as represented by FIG. 3, where the hydrogen halide is hydrogen chloride, hydrogen halide distillation column 93 is operated under the following representative conditions: a pressure of from 7.03 $Kg/cm^2$ (100 psi) to 8.44 $Kg/cm^2$ (120 psi); a feed temperature of 24° C. to 35° C.; an overhead temperature of from 32° C. to 43° C.; and a bottoms temperature of from 149° C. to 177° C. Under these conditions the concentrated hydrogen chloride distillate exiting distillation column 93 through conduit 87 has a concentration of hydrogen chloride of from 99% to 99.98% by weight, based on the total weight of concentrated hydrogen chloride distillate. The bottoms exiting distillation column 93 through conduit 90 have a hydrogen chloride concentration of from 12% to 15% by weight, based on the total weight of the bottoms. Distillation column 93 is preferably of the packed type, which uses acid corrosion resistant packing materials, e.g., packing materials based on silicon carbide, and is constructed of sufficiently acid corrosion resistant materials, e.g., titanium, tantalum, stainless steel and TEFLON® polytetrafluoroethylene lined stainless steel.

While FIGS. 1–4 depict singular representations of electrolytic cells, it should be understood that the scope of the present invention is also inclusive of the utilization of a plurality of such cells. The present invention may be practiced using a plurality of cells, e.g., electrolytic cells 6 or 3, either in series or parallel. In one embodiment, a plurality of cells, not shown, e.g., electrolytic cell 6, are utilized in series, wherein the outlets 49, 43 and 37 of each preceding cell are in respective communication with the inlets 46, 40 and 34 of each succeeding cell by means of additional conduits, not shown.

In another embodiment of the present invention, a plurality of cells, not shown, e.g., electrolytic cell 6, are utilized in parallel, wherein, for example, inlet 46 and outlet 49 of catholyte compartment 13 of each cell are in common closed loop communication with reservoir 75 by means of conduits and manifolds, not shown. Accordingly, the inlets and outlets of intermediate compartment 16 and anode compartment 10 of each cell are in common closed loop communication with reservoir 78 and reservoir 73 respectively, by means of conduits and manifolds, not shown.

The present invention is more particularly described in the following examples, which are intended to be illustrative only, since numerous modifications and variations therein will be apparent to those skilled in the art. Unless otherwise specified, all parts and percentages are by weight.

EXAMPLE 1

An electrolytic cell, as represented in FIG. 1, was constructed of poly(vinylidenefluoride) and used in this example. The intermediate compartment had a width of 3 millimeters (mm). The catholyte and anode compartments each had an active electrode area of 10 centimeters (cm)×10 cm available for electrochemical reaction. The cathode and the current collecting electrodes were each constructed in a mesh-like configuration of platinum coated titanium. A NEOSEPTA® ACM anion exchange membrane, available from Tokuyama Soda of Japan, was used. A NAFION® 117 cation exchange membrane, available from E. I. Du Pont de Nemours and Company, was used. The hydrogen consuming gas diffusion anode was comprised of 5% by weight of platinum supported on carbon and 95% by weight of TEFLON® polytetrafluoroethylene having a platinum per surface area value of 4 mg/cm$^2$. The hydrogen consuming gas diffusion anode was hot pressed between the NAFION® 117 cation exchange membrane and TEFLON® polytetrafluoroethylene treated carbon cloth comprised of 10% by weight of TEFLON® polytetrafluoroethylene and 90% by weight of carbon.

An aqueous mixture of amine hydrochlorides having the following composition was used: 65% by weight of water, 30% by weight of a mixture of ethyleneamine monohydrochlorides, and 5% by weight, based on the total weight of the aqueous mixture, of ammonium chloride. The ethyleneamines of the mixture of ethyleneamine monohydrochlorides were comprised of 48% by weight of ethylenediamine, 21% by weight of diethylenediamine, 15% by weight of triethylenetetramine and 16% by weight of E-100 heavy amines from Dow Chemical, based on the total weight of ethyleneamines. The aqueous solution of ethylenediamine monohydrochlorides was prepared by adding hydrogen chloride to an aqueous solution of the free ethyleneamines in an amount sufficient to convert half of the available amine groups to amino hydrochloride groups.

The aforedescribed aqueous mixture of ethyleneamine monohydrochlorides was circulated through the catholyte compartment at a rate of 180 ml/minute from a temperature controlled stainless steel reservoir using a fluid metering pump. An aqueous conductive electrolyte solution comprised of 14% by weight of hydrogen chloride was circulated through the intermediate compartment at a rate of 15 ml/minute from a temperature controlled stainless steel reservoir using a fluid metering pump. Both of the reservoirs for the catholyte and intermediate compartments were maintained at a temperature of from 40° C. to 50° C. The flow of hydrogen gas through the anode compartment was maintained at a rate of 1000 ml/minute using a mass flow controller with a back pressure of 51 centimeters (cm) of water. The electrolytic cell of Example 1 was operated at a current density of 5.6 amps/cm$^2$ and with a limiting cell voltage of 5 volts.

After operating the electrolytic cell of Example 1 as described for twenty hours, 99.3% of the original mole equivalents of the mixture of ethyleneamine monohydrochlorides were found to have been converted to a mixture of free ethyleneamines. The percent conversion was determined by comparing the results of acid titration, using a standard HCl solution, of samples withdrawn from the catholyte compartment both before and after operation of the electrolytic cell.

EXAMPLE 2

An electrolytic cell similar to that described in Example 1, but in which the intermediate compartment had a width of 10 mm, was used. An aqueous solution of 25% by weight, based on the total weight of aqueous solution, of ethylenediamine monohydrochloride was circulated at a rate of 180 milliliters (ml)/minute through the catholyte compartment from a temperature controlled stainless steel reservoir under a hydrogen gas atmosphere using a fluid metering pump. The aqueous solution of ethylenediamine monohydrochloride was prepared by adding hydrogen chloride to a solution of free ethylenediamine in an amount sufficient to convert half of the available amine groups to amino hydrochloride groups. An aqueous conductive electrolyte solution comprised of 15% by weight, based on the total weight of the aqueous conductive electrolyte solution, of sodium chloride was circulated through the intermediate compartment at a rate of 20 ml/minute from a temperature and pH controlled stainless steel reservoir using a fluid metering pump. Both of the reservoirs for the catholyte and intermediate compartments were maintained at a temperature of from 40° C. to 50° C.

The pH of the reservoir for the intermediate compartment was maintained at a value of at least 8.0 by the introduction of an aqueous solution containing 10% by weight of sodium hydroxide, based on the total weight of the aqueous solution, from an automatic pH control device obtained from Cole-Parmer Inc. The flow of hydrogen gas through the anode compartment was maintained at a rate of 1000 ml/minute using a mass flow controller with a back pressure of 51 centimeters (cm) of water.

The electrolytic cell of Example 2 was equipped with devices for measuring temperature, and connected to a power source having voltage and current control, and a coulomb counter. The electrolytic cell was operated at a current of 20 amperes (amps) for a period of two hours. The results of analysis of samples withdrawn from the catholyte compartment after two hours of operation are summarized in Table 1.

TABLE 1

| Time[a] (Hours) | Free Ethylenediamine Produced[b] (mEQ) | Total Charge Consumed[c] (Coulombs) | % Current Efficiency[d] |
|---|---|---|---|
| 2 | 1427 | 150,300 | 93% |

[a]Time at which the sample was withdrawn for analysis from the catholyte compartment.
[b]The amount of free ethylenediamine (EDA) produced within the catholyte compartment was determined by acid titration of the withdrawn sample using a standard HCl solution.
[c]Total Charge Consumed was determined by taking readings from the coulomb counter. The value shown is cumulative.
[d]% Current Efficiency determined by the following equation: 100 × (actual free EDA produced in the catholyte compartment/theory free EDA that could have been produced in the catholyte compartment). The actual free EDA produced was determined as described above. The theory free EDA produced was determined by calculation using the Faraday equation and the measured amount of charge consumed.

The results of Examples 1 and 2 demonstrate that the conversion of ethyleneamine hydrochlorides to free ethyleneamines, in accordance with the practice of the method of the present invention, can be achieved with high levels of percent conversion, and high current efficiency.

The present invention has been described with reference to specific details of particular embodiments thereof. It is not intended that such details be regarded as limitations upon the scope of the invention except insofar as and to the extent that they are included in the accompanying claims.

We claim:

1. A method of converting amine hydrohalide into free amine comprising:

(a) providing an electrolytic cell having a catholyte compartment containing a cathode assembly; an anode compartment containing an anode assembly; and an intermediate compartment separating said catholyte and anode compartments; said cathode assembly comprising a cathode and an anion exchange membrane, said anode assembly comprising a hydrogen consuming gas diffusion anode and a current collecting electrode, said intermediate compartment being separated from said catholyte and said anode compartments by said anion exchange membrane and said hydrogen consuming gas diffusion anode;

(b) introducing an aqueous solution of amine hydrohalide into said catholyte compartment;

(c) introducing hydrogen gas into said anode compartment;

(d) introducing an aqueous conductive electrolyte solution into said intermediate compartment;

(e) passing direct current through said electrolytic cell; and (f) removing an aqueous solution comprising free amine from said catholyte compartment.

2. The method of claim 1 wherein said anode assembly further comprises a hydraulic barrier, said hydrogen consuming gas diffusion anode being fixedly held between said hydraulic barrier and said current collecting electrode, and said intermediate compartment is separated from said anode compartment by said hydraulic barrier.

3. The method of claim 2 wherein the amine hydrohalide is an amine hydrochloride.

4. The method of claim 3 wherein the amine of the amine hydrochloride is selected from the group consisting of ammonia, monoalkylamines, dialkylamines, trialkylamines, ethyleneamines, alkyl ethylenediamines, propylenediamines, alkyl propylenediamines, monoalkanolamines, dialkanolamines, trialkanolamines, cycloaliphatic amines, aromatic amines and mixtures thereof.

5. The method of claim 4 wherein the amine of the amine hydrochloride is an ethyleneamine which is selected from the group consisting of ethylenediamine, diethylenetriamine, triethylenetetramine, tetraethylenepentamine, pentaethylenehexamine, piperazine, 1-(2-aminoethyl)piperazine and mixtures thereof.

6. The method of claim 2 wherein said aqueous conductive electrolyte solution comprises a hydrogen halide aqueous solution having a concentration of from 1% by weight to 25% by weight hydrogen halide, based on the total weight of said aqueous conductive electrolyte solution.

7. The method of claim 6 wherein the concentration of hydrogen halide in said aqueous conductive electrolyte solution is maintained below 25% by weight by introducing an aqueous stream selected from the group consisting of water, aqueous alkali metal hydroxide and a mixture of aqueous alkali metal hydroxide and alkali metal halide into said intermediate compartment.

8. The method of claim 2 wherein said aqueous conductive electrolyte solution comprises a hydrogen halide aqueous solution and wherein the hydrogen halide concentration of said aqueous hydrogen halide solution is maintained below 25% by weight, based on the total weight of said aqueous conductive electrolyte solution.

9. The method of claim 7 wherein the concentration of hydrogen halide in said aqueous hydrogen halide solution is maintained below 25% by weight by distilling aqueous hydrogen halide solution removed from said intermediate compartment to produce a concentrated hydrogen halide distillate product and bottoms product; and either (a) returning bottoms product to said intermediate compartment or (b) introducing an aqueous stream selected from the group consisting of water and an aqueous hydrogen halide solution having a concentration of hydrogen halide of less than 25% by weight into said intermediate compartment.

10. The method of claim 2 wherein a positive internal pressure difference of from 0.07 $kg/cm^2$ to 1.40 $kg/cm^2$ exists between said intermediate compartment and each of said catholyte and anode compartments.

11. The method of claim 2 wherein said hydrogen consuming gas diffusion anode comprises platinum supported on carbon dispersed in polytetrafluoroethylene.

12. The method of claim 11 wherein said anion exchange membrane comprises a copolymer of styrene and divinylbenzene having pendent quaternary ammonium salt groups, and said hydraulic barrier is a cation exchange membrane comprising a perfluoropolymer having pendent sulfonic acid groups.

13. The method of claim 12 wherein said cathode and said current collecting electrode each comprises a material selected from the group consisting of graphite, platinum, titanium coated with platinum, titanium coated with an oxide of ruthenium, nickel, stainless steel, high alloy steel and appropriate combinations thereof.

14. The method of claim 2 further comprising the step of passing aqueous solution comprising free amine removed from said catholyte compartment through an anion exchange resin.

15. The method of claim 2 wherein the anion exchange membrane of said cathode assembly comprises a copolymer of styrene and divinylbenzene having pendent quaternary ammonium salt groups; said hydrogen consuming gas diffusion anode of said anode assembly comprises platinum supported on carbon dispersed in polytetrafluoroethylene; said hydraulic barrier is a cation exchange membrane comprising a perfluoropolymer having pendent sulfonic acid groups; and the amine hydrohalide is an amine hydrochloride.

16. The method of claim 15 wherein the amine of the amine hydrochloride is an ethyleneamine which is from the group consisting of ethylenediamine, diethylenetriamine, triethylenetetramine, tetraethylenepentamine, pentaethylenehexamine, piperazine, 1-(2-aminoethyl) piperazine and mixtures thereof; and said cathode and said current collecting electrode each comprises a material selected from the group consisting of graphite, platinum, titanium coated with platinum, titanium coated with an oxide of ruthenium, nickel, stainless steel, high alloy steel and appropriate combinations thereof.

17. The method of claim 16 wherein a positive internal pressure difference of from 0.07 $kg/cm^2$ to 1.40 $kg/cm^2$ exists between said intermediate compartment and each of said catholyte and anode compartments.

18. The method of claim 17 wherein said aqueous conductive electrolyte solution comprises a hydrogen chloride aqueous solution and wherein the hydrogen chloride concentration of said aqueous hydrogen chloride solution is maintained below 25% by weight, based on the total weight of said aqueous conductive electrolyte solution.

19. The method of claim 18 wherein the concentration of said hydrogen chloride in said aqueous hydrogen chloride solution is maintained below 25% by weight by introducing an aqueous stream selected from the group consisting of water, aqueous alkali metal hydroxide and a mixture of aqueous alkali metal hydroxide and alkali metal halide into said intermediate compartment.

20. The method of claim 18 wherein the concentration of said hydrogen chloride in said aqueous hydrogen chloride solution is maintained below 25% by weight by distilling aqueous hydrogen chloride solution removed from said intermediate compartment to produce a concentrated hydrogen chloride distillate product and bottoms product; and either (a) returning bottoms product to said intermediate compartment or (b) introducing an aqueous stream selected from the group consisting of water and an aqueous hydrogen chloride solution having a concentration of hydrogen chloride of less than 25% by weight into said intermediate compartment.

21. The method of claim 15 further comprising the step of passing aqueous solution comprising free amine removed from said catholyte compartment through an anion exchange resin.

22. An electrolytic cell comprising: a catholyte compartment containing a cathode assembly; an anode compartment containing an anode assembly; and an intermediate compartment separating said catholyte and anode compartments; said cathode assembly comprising a cathode and an anion exchange membrane, said anode assembly comprising a hydrogen consuming gas diffusion anode fixedly held between a cation exchange membrane and a current collecting electrode, said intermediate compartment being separated from said catholyte and said anode compartments by said anion exchange membrane and said cation exchange membrane.

* * * * *